US008734126B2

(12) United States Patent
Nishimura et al.

(10) Patent No.: US 8,734,126 B2
(45) Date of Patent: May 27, 2014

(54) SCREW COMPRESSOR

(75) Inventors: Hitoshi Nishimura, Shizuoka (JP); Tomoo Suzuki, Shizuoka (JP); Hiroshi Ohta, Shizuoka (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 13/494,058

(22) Filed: Jun. 12, 2012

(65) Prior Publication Data

US 2012/0251372 A1 Oct. 4, 2012

Related U.S. Application Data

(60) Continuation of application No. 12/348,942, filed on Jan. 6, 2009, now Pat. No. 8,221,094, which is a division of application No. 11/367,380, filed on Mar. 6, 2006, now Pat. No. 8,231,363.

(30) Foreign Application Priority Data

Jun. 9, 2005 (JP) ..... 2005-169661

(51) Int. Cl.

| | |
|---|---|
| ***F04B 25/00*** | (2006.01) |
| ***F01C 1/30*** | (2006.01) |
| ***F01C 11/00*** | (2006.01) |
| ***F04C 11/00*** | (2006.01) |
| ***F04C 23/00*** | (2006.01) |

(52) U.S. Cl.
USPC ..... 417/243; 417/244; 417/247; 418/9

(58) Field of Classification Search
USPC ..... 417/243, 244, 247; 418/9, 83, 101, 418/201.1
See application file for complete search history.

(56) References Cited

U.S. PATENT DOCUMENTS 1,626,768 A * 5/1927 Vollmann ..... 418/98
1,673,262 A * 6/1928 Meston et al. ..... 418/84

(Continued)

FOREIGN PATENT DOCUMENTS

CN 2039370 U 6/1989
JP 55-3108 U 1/1980

(Continued)

OTHER PUBLICATIONS

Japanese Office Action of Appln. No. 2005-169661 dated Aug. 10, 2010.

(Continued)

*Primary Examiner* — Charles Freay
*Assistant Examiner* — Alexander Comley
(74) *Attorney, Agent, or Firm* — Antonelli, Terry, Stout & Kraus, LLP.

(57) ABSTRACT

A screw compressor includes a low pressure stage compressor body; a high pressure stage compressor body that further compresses a compressed air compressed by the low pressure stage compressor body; pinion gears for example, respectively, provided on, for example, a male rotor of the low pressure stage compressor body and, for example, a male rotor of the high pressure stage compressor body; a motor; a bull gear for example, provided on a rotating shaft of the motor; and an intermediate shaft supported rotatably and provided with a pinion gear, which meshes with the bull gear, and a bull gear, which meshes with the pinion gears. Thereby, it is possible to make the motor relatively low in rotating speed while inhibiting the gears from being increased in diameter, thus enabling achieving reduction in cost.

9 Claims, 11 Drawing Sheets

(56) References Cited

U.S. PATENT DOCUMENTS

| | | | | | |
|---|---|---|---|---|---|
| 2,549,652 | A | * | 4/1951 | Wilhelm | 74/606 R |
| 2,699,725 | A | * | 1/1955 | Quinn | 417/288 |
| 2,880,676 | A | * | 4/1959 | Succop | 417/410.4 |
| 3,407,996 | A | * | 10/1968 | Olofsson et al. | 418/9 |
| 3,576,379 | A | * | 4/1971 | Parise | 417/410.4 |
| 3,630,040 | A | * | 12/1971 | Goldfarb | 62/5 |
| 3,791,352 | A | * | 2/1974 | Takacs | 123/239 |
| 3,910,731 | A | * | 10/1975 | Persson et al. | 418/9 |
| 4,076,468 | A | * | 2/1978 | Persson et al. | 418/9 |
| 4,174,196 | A | * | 11/1979 | Mori et al. | 418/9 |
| 4,452,575 | A | * | 6/1984 | Schibbye et al. | 418/1 |
| 4,529,363 | A | * | 7/1985 | Suzuki | 417/295 |
| 4,725,210 | A | * | 2/1988 | Suzuki et al. | 418/83 |
| 4,761,123 | A | * | 8/1988 | Sowards et al. | 418/89 |
| 4,767,284 | A | * | 8/1988 | Shiinoki et al. | 417/312 |
| 4,929,161 | A | * | 5/1990 | Aoki et al. | 418/83 |
| 4,940,398 | A | * | 7/1990 | Berges et al. | 417/410.4 |
| 5,106,270 | A | * | 4/1992 | Goettel et al. | 417/243 |
| 5,364,245 | A | * | 11/1994 | Kriehn et al. | 418/9 |
| 5,378,128 | A | * | 1/1995 | Yanagisawa | 418/9 |
| 5,447,422 | A | * | 9/1995 | Aoki et al. | 418/83 |
| 5,613,843 | A | * | 3/1997 | Tsuru et al. | 417/313 |
| 5,795,136 | A | * | 8/1998 | Olsaker et al. | 417/295 |
| 5,846,062 | A | * | 12/1998 | Yanagisawa et al. | 417/410.4 |
| 6,022,200 | A | * | 2/2000 | Myers | 417/423.15 |
| 6,027,311 | A | * | 2/2000 | Hill et al. | 417/53 |
| 6,220,825 | B1 | * | 4/2001 | Myers et al. | 417/313 |
| 6,416,302 | B1 | * | 7/2002 | Achtelik et al. | 418/201.1 |
| 6,478,560 | B1 | * | 11/2002 | Bowman | 418/199 |
| 6,551,082 | B2 | * | 4/2003 | Douzono et al. | 418/83 |
| 6,604,911 | B2 | * | 8/2003 | Pauwels | 417/53 |
| 6,652,250 | B2 | * | 11/2003 | Yoshimura | 417/410.4 |
| 6,679,689 | B2 | * | 1/2004 | Takahashi et al. | 418/9 |
| 6,692,235 | B2 | * | 2/2004 | Kolodziej et al. | 417/243 |
| 6,695,591 | B2 | * | 2/2004 | Grimmer et al. | 417/203 |
| 6,991,440 | B2 | * | 1/2006 | Achtelik et al. | 418/9 |
| 7,044,716 | B2 | * | 5/2006 | Fabry | 417/243 |
| 2003/0059326 | A1 | * | 3/2003 | Douzono et al. | 418/9 |
| 2003/0223897 | A1 | * | 12/2003 | Ferentinos | 418/9 |
| 2004/0062668 | A1 | * | 4/2004 | Achtelik et al. | 418/9 |
| 2004/0184927 | A1 | * | 9/2004 | Kolodziej et al. | 417/243 |

FOREIGN PATENT DOCUMENTS

| | | | | | |
|---|---|---|---|---|---|
| JP | 59-185988 | | | 10/1984 | |
| JP | 61-4889 | | | 1/1986 | |
| JP | 2-145688 | | | 12/1990 | |
| JP | 05-209594 | | | 8/1993 | |
| JP | 6-185485 | | | 7/1994 | |
| JP | 08-189484 | | | 7/1996 | |
| JP | 08189484 | A | * | 7/1996 | F04C 18/16 |
| JP | 10-148192 | | | 6/1998 | |
| JP | 11-141488 | | | 5/1999 | |
| JP | 2002-155879 | | | 5/2002 | |
| JP | 2002-364568 | | | 12/2002 | |
| WO | WO 80/00169 | | | 2/1980 | |

OTHER PUBLICATIONS

Office Action of Chinese Appln. No. 200810212839.6 dated Oct. 30, 2009.

Partial Search Report of Belgium Application dated Jul. 4, 2011.

JP Office Action of Appln. No. 2010-224030 dated Sep. 11, 2012.

* cited by examiner

SCREW COMPRESSOR

CROSS-REFERENCE TO RELATED APPLICATION

This application is a continuation application of U.S. application Ser. No. 12/348,942, filed Jan. 6, 2009 now U.S. Pat. No. 8,221,094, which is a divisional application of U.S. application Ser. No. 11/367,380, filed Mar. 6, 2006 now U.S. Pat. No. 8,231,363, the contents of which are incorporated herein by reference.

INCORPORATION BY REFERENCE

The present application claims priority from Japanese application JP2005-169661 filed on Jun. 9, 2005, the content of which is hereby incorporated by reference into this application.

BACKGROUND OF THE INVENTION

The present invention relates to a screw compressor, and more particular, to a large capacity screw compressor that generates a compressed air.

Screw compressors comprise a male rotor and a female rotor, of which rotating shafts are in parallel to each other and which rotate so that spiral teeth thereof mesh with each other, and a casing that accommodates therein the male rotor and the female rotor. A plurality of compressive working chambers are defined by tooth grooves of the male rotor and the female rotor, and an inner wall of the casing. The compressive working chambers are decreased in volume to compress an air while moving in an axial direction as the male rotor and the female rotor rotate.

Conventionally, the construction for a two stage type screw compressor is exemplarily disclosed, which comprises: a low pressure stage compressor body; an intercooler that cools a compressed air from the low pressure stage compressor body; a high pressure stage compressor body that further compresses the compressed air cooled by the intercooler; and an aftercooler that cools the compressed air from the high pressure stage compressor body (for example, see JP-A-2002-155879). According to the related art, pinion gears, respectively, are mounted on rotor shafts (either of a male rotor and a female rotor) of the low pressure stage compressor body and the high pressure stage compressor body. The pinion gears, respectively, mesh with a bull gear, which is mounted on a rotating shaft of a motor (electric motor). As the motor is driven, a rotational power of the motor is transmitted and increased in speed through the bull gear and the pinion gears, whereby the low pressure stage compressor body and the high pressure stage compressor body, respectively, are driven.

However, the related art leaves the following room for improvement.

That is, according to the related art, a speed increasing ratio is determined by a ratio of a working pitch diameter of the bull gear on a side of the motor to a working pitch diameter of the pinion gear on a side of the compressor body, and a rotational power of the motor is increased in speed in one stage according to the speed increasing ratio to drive the low pressure stage compressor body and the high pressure stage compressor body, respectively. Therefore, in order to obtain a predetermined speed increasing ratio in a compressor unit of a large capacity with, for example, an output of several hundreds of kilowatts (kw), it is necessary to increase a diameter of the bull gear on the side of the motor corresponding to the pinion gear on the side of the compressor body, or to decrease a speed increasing ratio to heighten the rotational speed of the motor. In the case where the gear is to be made large in diameter, manufacture becomes sometimes difficult in terms of a manufacturing facility (for example, limitation in a range of working performed by a machine tool). Consequently, the gears or the motor is increased in cost.

BRIEF SUMMARY OF THE INVENTION

It is an object of the invention to provide a screw compressor, a motor of which can be made relatively low in rotating speed while inhibiting gears from being increased in diameter, thereby enabling achieving reduction in cost.

(1) In order to attain the object, the invention provides a screw compressor comprising:

a compressor body;

a rotor side gear provided on a rotor shaft of the compressor body;

a motor;

a motor side gear provided on a rotating shaft of the motor; and an intermediate shaft supported rotatably and provided with a first speed-increasing gear, which meshes with the motor side gear, and a second speed-increasing gear, which meshes with the rotor side gear.

According to the invention, there is provided an intermediate shaft provided with a first speed-increasing gear, which meshes with the motor side gear, and a second speed-increasing gear, which meshes with the rotor side gear. A speed increasing ratio of the motor side gear to the first speed-increasing gear, and a speed increasing ratio of the second speed-increasing gear to the rotor side gear cause a rotational power of the rotating shaft of the motor to be increased in speed in two stages and transmitted, thus rotationally driving the rotor shaft of the compressor body. Thereby, as compared with, for example, the case where the motor side gear and the rotor side gear meshes with each other to attain an increase in speed in one stage, it is possible to make the motor relatively low in rotating speed while inhibiting the gears from being increased in diameter, thus enabling achieving reduction in cost.

(2) In order to attain the object, the invention provides a screw compressor comprising:

a low pressure stage compressor body;

a high pressure stage compressor body that further compresses a compressed air compressed by the low pressure stage compressor body;

a plurality of rotor side gears, respectively, provided on rotor shafts of the low pressure stage compressor body and the high pressure stage compressor body;

a motor;

a motor side gear provided on a rotating shaft of the motor; and an intermediate shaft supported rotatably and provided with a first speed-increasing gear, which meshes with the motor side gear, and a second speed-increasing gear, which meshes with the plurality of rotor side gears.

(3) In (1) or (2), preferably, the rotating shaft of the motor and the rotor shaft of the compressor body are arranged in parallel to each other, and the motor and the compressor body are arranged upward and downward on one side in axial directions thereof.

Thereby, as compared with, for example, the case where a motor is arranged on one side in an axial direction and a compressor body is arranged on the other side in the axial direction, the whole axial dimension composed of the motor, the compressor body, etc. can be shortened. Consequently, an arrangement of the compressor unit can be heightened in freedom of layout.

(4) In (3), preferably, the rotating shaft of the motor and the rotor shaft of the compressor body are arranged with axial directions thereof oriented in a short width direction of the compressor unit.

(5) In order to attain the object, the invention also provides a screw compressor comprising:

a low pressure stage compressor body;

a high pressure stage compressor body that further compresses a compressed air compressed by the low pressure stage compressor body;

a plurality of rotor side gears, respectively, provided on rotor shafts of the low pressure stage compressor body and the high pressure stage compressor body;

a motor;

a motor side gear provided on a rotating shaft of the motor; an intermediate shaft supported rotatably and provided with a first speed-increasing gear, which meshes with the motor side gear, and a second speed-increasing gear, which meshes with the plurality of rotor side gears;

a gear casing that accommodates therein the motor side gear, the first speed-increasing gear, the intermediate shaft, the second speed-increasing gear, and the rotor side gears;

a first cooling apparatus that cools a compressed air from the low pressure stage compressor body; and a second cooling apparatus that cools a compressed air from the high pressure stage compressor body, wherein the motor, the gear casing, the low pressure stage compressor body, and the high pressure stage compressor body are arranged centrally of the compressor unit, the first cooling apparatus is arranged on one side in a long width direction of the compressor unit, and the second cooling apparatus is arranged on the other side in the long width direction of the compressor unit.

As described in (3), for example, when the rotating shaft of the motor and the rotor shaft of the high pressure stage compressor body are arranged in parallel to each other, and the motor, the low pressure stage compressor body, and the high pressure stage compressor body are arranged upward and downward on one side in axial directions thereof, the whole axial dimension composed of the motor, the low pressure stage compressor body, the high pressure stage compressor body, etc. can be shortened. Thereby, axial directions of the rotating shaft of the motor and the rotor shafts of the low pressure stage compressor body and the high pressure stage compressor body can be arranged in the short width direction of the compressor unit. The motor, the gear casing, the low pressure stage compressor body, the high pressure stage compressor body, etc. are arranged centrally of the compressor unit, and interposing them, the first and second cooling apparatuses, respectively, are arranged on one side and on the other side in the long width direction of the compressor unit. Consequently, it is possible to arrange elements in the compressor unit in an efficient and well-balanced manner, thus enabling making the whole unit small in size.

(6) In (5), preferably, the rotating shaft of the motor and the rotor shafts of the low pressure stage compressor body and the high pressure stage compressor body are arranged in parallel to each other with axial directions thereof oriented in a short width direction of the compressor unit, and the motor, the low pressure stage compressor body and the high pressure stage compressor body are arranged upward and downward on one side in the axial directions.

(7) In (6), preferably, the low pressure stage compressor body is arranged on one side in a long width direction of the compressor unit in the gear casing, and the high pressure stage compressor body is arranged on the other side in the long width direction of the compressor unit in the gear casing.

Thereby, it is possible to shorten a connection pipe between the low pressure stage compressor body and the first cooling apparatus, and a connection pipe between the high pressure stage compressor body and the second cooling apparatus.

(8) In any one of (5) to (7), preferably, the first and second cooling apparatuses, respectively, comprise: a duct provided in a substantially vertical direction; a cooling fan provided in the duct to generate a cooling wind; and a heat exchanger for compressed air, provided upstream of the cooling fan in the duct to exchange heat with a cooling wind to cool a compressed air from the low pressure stage compressor body or the high pressure stage compressor body.

(9) In (8), preferably, the duct is connected to an air intake port and an exhaust port of the compressor unit, an intake space is formed between the air intake port and the heat exchanger for compressed air, and an exhaust space is formed between the cooling fan and the exhaust port.

Thereby, as compared with, for example, the case where any intake space is not formed between the air intake port and the heat exchanger for compressed air, and the case where any exhaust space is not formed between the cooling fan and the exhaust port, it is possible to reduce leakage of noise generated in the heat exchanger for compressed air, etc.

(10) In (8), preferably, one of or both of the first and second cooling apparatuses are provided with a plurality of the heat exchangers for compressed air, and the plurality of the heat exchangers for compressed air are arranged in juxtaposition with flow of a cooling wind.

In, for example, a compressor unit of a large capacity, a heat exchanger for compressed air becomes large in size, so that it becomes sometimes difficult to manufacture it in existent manufacturing facilities (for example, due to a problem of a size of a furnace or the like). According to the invention, a plurality of the heat exchangers for compressed air are provided, and they are arranged in juxtaposition with flow of a cooling wind in the duct. Thereby, the single heat exchanger for compressed air becomes small in size, so that it is possible to facilitate manufacture thereof even in the case where the size thereof is limited by an existent manufacturing facility or the like. Furthermore, pressure loss is decreased as compared with the case where, for example, a plurality of heat exchangers for compressed air are arranged in series, so that it is possible to reduce power required for a cooling fan.

(11) In (10), preferably, the cooling fans are provided in plural so as to pair with the plurality of the heat exchangers and are arranged in juxtaposition with one another.

(12) In (10), preferably, the plurality of the heat exchangers for compressed air are arranged in juxtaposition with one another in the short width direction of the compressor unit.

(13) In (8), preferably, the heat exchanger for compressed air is provided in a manner to be inclined to vertical flow of a cooling wind in the duct.

In this manner, by inclining the heat exchanger for compressed air, it is possible to shorten a dimension in the short width direction of the compressor unit.

(14) In (8), preferably, one of or both of the first and second cooling apparatuses are provided with a plurality of the heat exchangers for compressed air, the plurality of the heat exchangers for compressed air are inclined to vertical flow of a cooling wind in the duct and arranged in juxtaposition therewith, and heat exchangers for oil are provided between the plurality of the heat exchangers for compressed air.

According to the invention, it is possible to make a motor relatively low in rotating speed while inhibiting gears from being increased in diameter, thus enabling achieving reduction in cost.

Other objects, features and advantages of the invention will become apparent from the following description of the embodiments of the invention taken in conjunction with the accompanying drawings.

DETAILED DESCRIPTION OF THE INVENTION

Embodiments of the invention will be described below with reference to the drawings.

A first embodiment of the invention will be described with reference to FIGS. 1 to 5.

Figure 1:
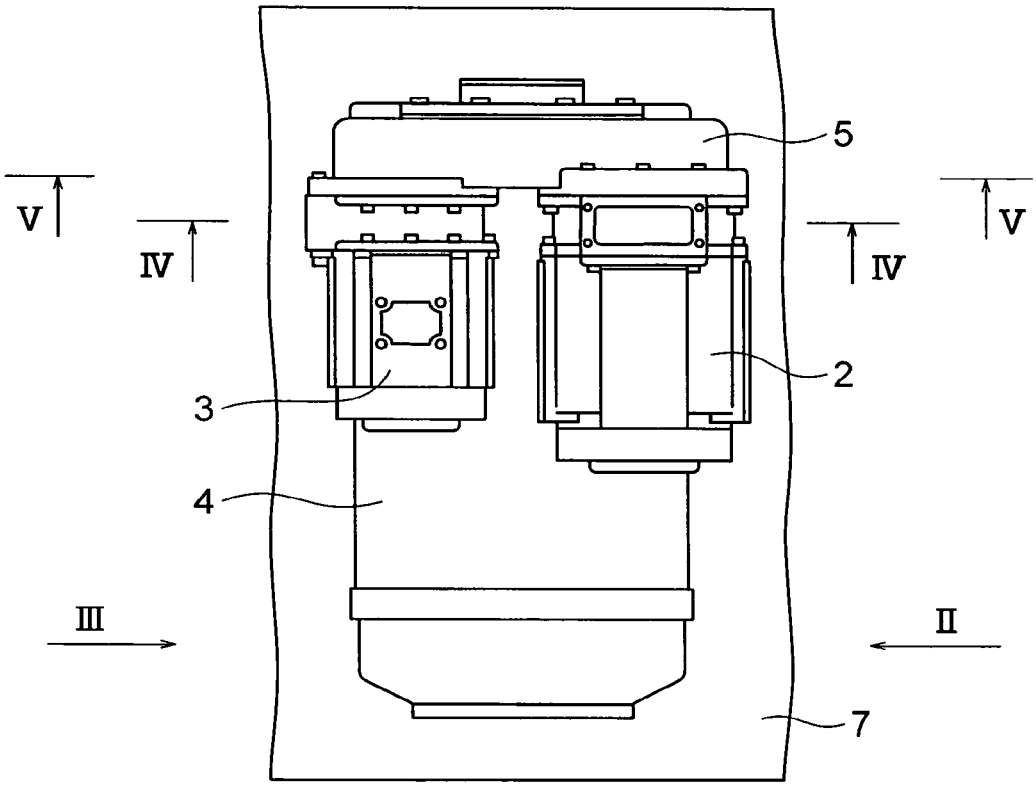
FIG. 1 is a plan view showing the construction of a first embodiment of a screw compressor according to the invention.
Figure 2:
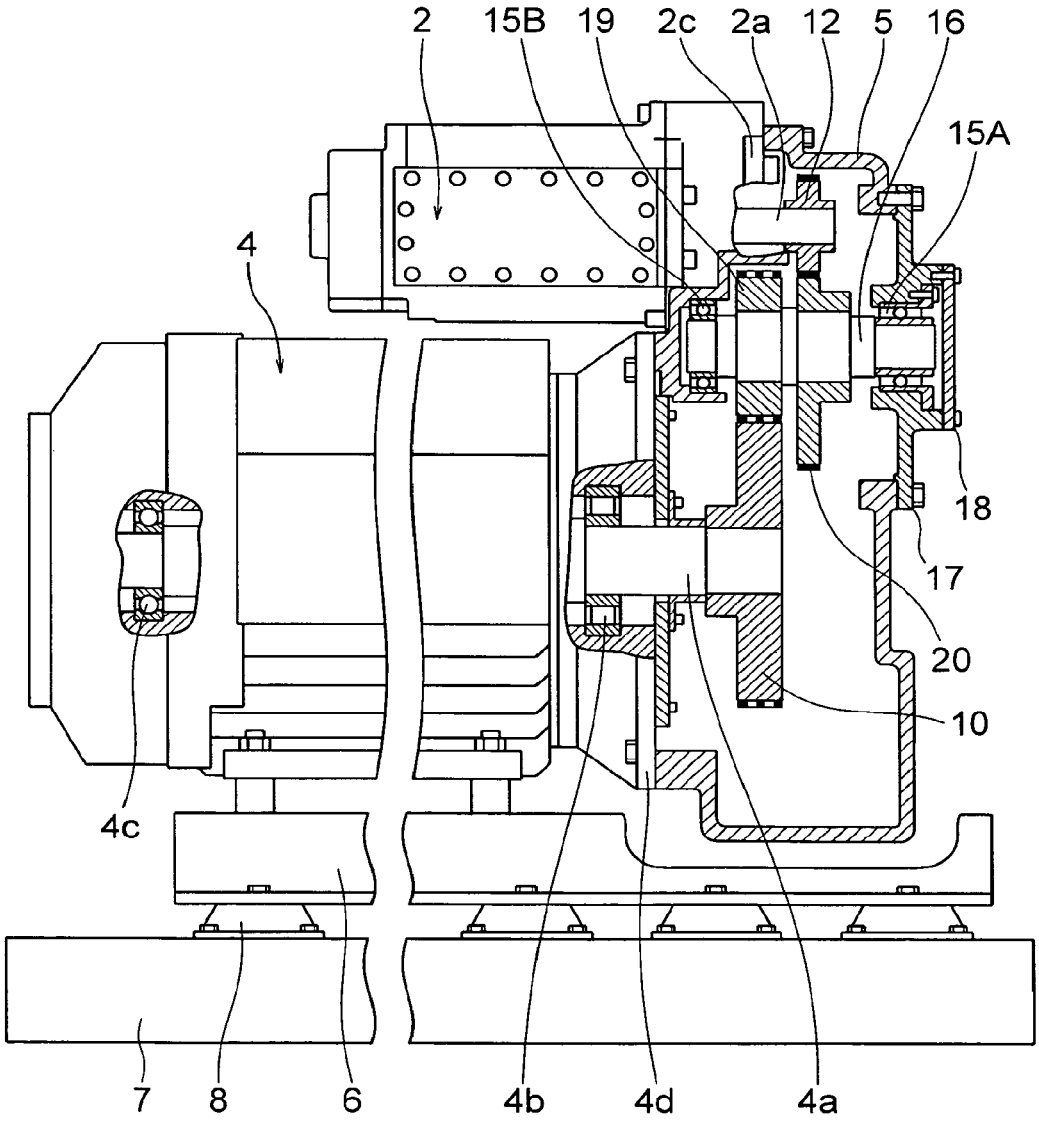
FIG. 2 is a side view as viewed in a direction of an arrow II in FIG. 1.
Figure 3:
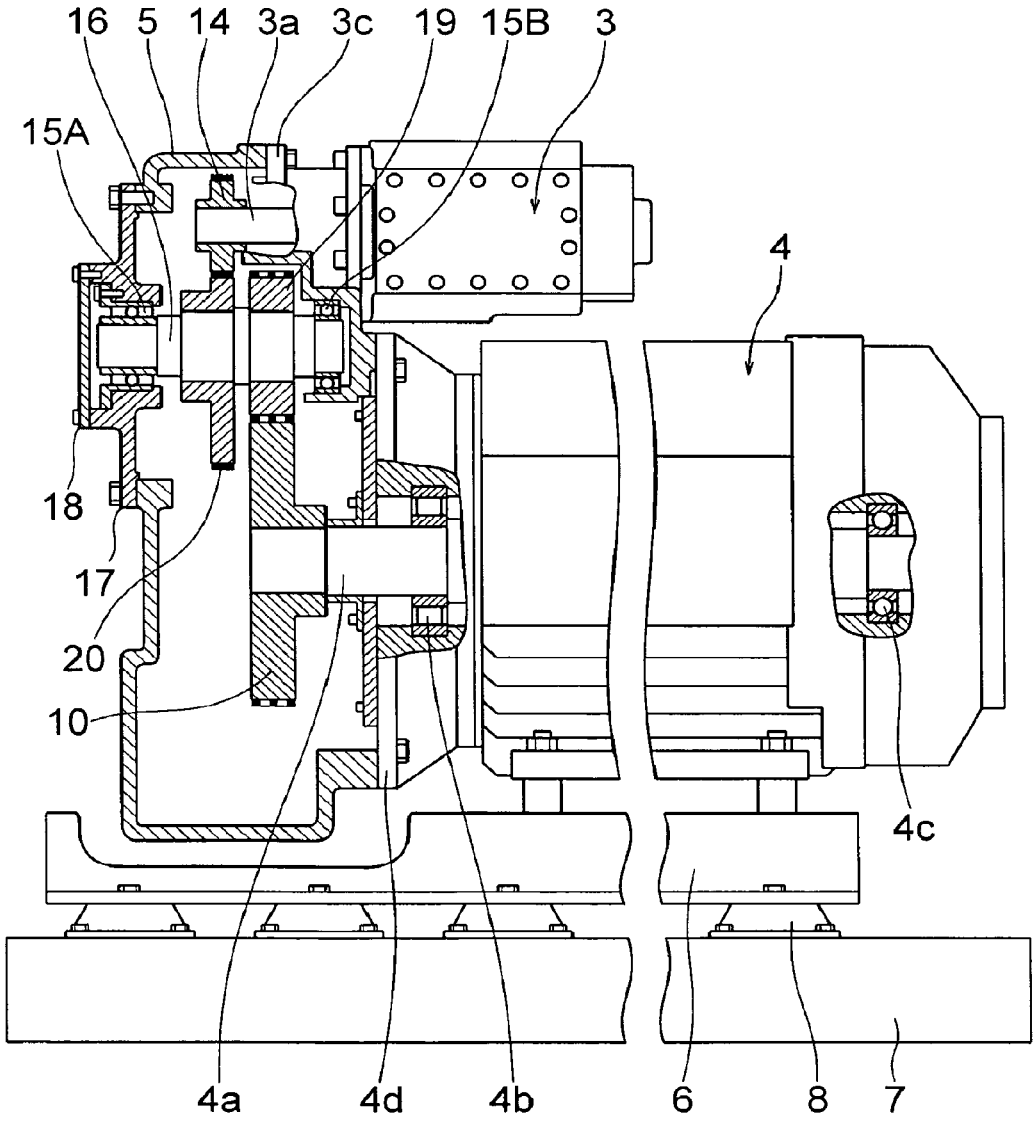
FIG. 3 is a side view as viewed in a direction of an arrow III in FIG. 1.
Figure 4:
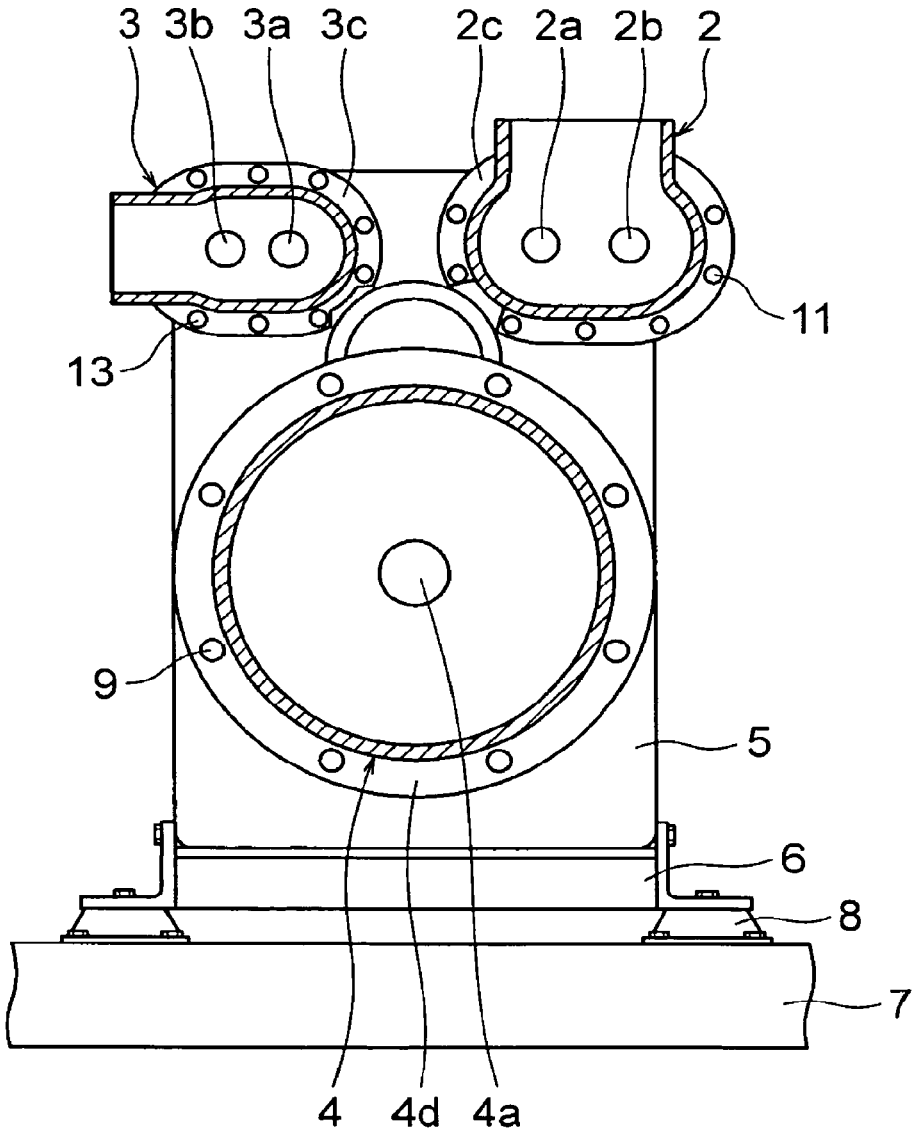
FIG. 4 is a side, cross sectional view taken along a cross section IV-IV in FIG. 1.
Figure 5:
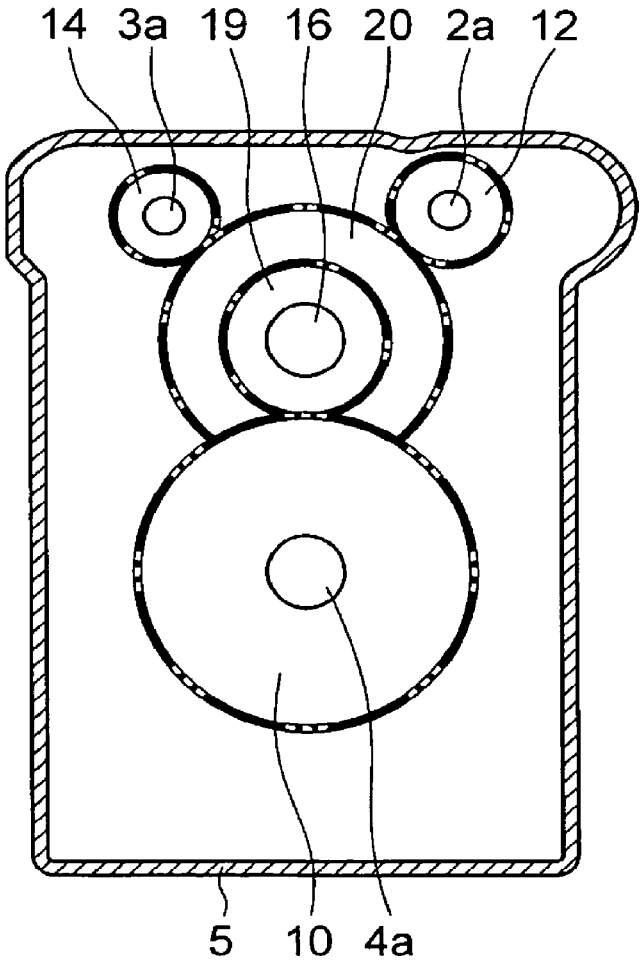
FIG. 5 is a side, cross sectional view taken along a cross section V-V in FIG. 1.

FIG. 1 is a plan view showing the construction of a screw compressor according to the embodiment. FIG. 2 is a side view as viewed in a direction indicated by an arrow II in FIG. 1. FIG. 3 is a side view as viewed in a direction indicated by an arrow III in FIG. 1. FIG. 4 is a side, cross sectional view taken along a cross section IV-IV in FIG. 1, and FIG. 5 is a side, cross sectional view taken along a cross section V-V in FIG. 1 (only an interior of a casing is shown).

In FIGS. 1 to 5, there are provided: a low pressure stage compressor body 2 that compresses an air, which is sucked thereinto through a suction throttle valve 1 (not shown in the drawings, but see the drawings illustrated later), to a predetermined intermediate pressure; a high pressure stage compressor body 3 that compresses the compressed air, which has been compressed by the low pressure stage compressor body 2, further to a predetermined discharge pressure; a motor (electric motor) 4; and a gear casing 5 accommodating therein a gear mechanism (details of which are described later) that transmits a rotational power of the motor 4 to the low pressure stage compressor body 2 and the high pressure stage compressor body 3. In addition, an oil reservoir (not shown) is provided in a lower region within the gear casing 5.

The motor 4 is fixed to a motor frame 6. The motor frame 6 is mounted on a base 7 with a plurality of vibration-proof rubber pieces 8 therebetween. A rotating shaft 4*a* of the motor 4 is supported rotatably through, for example, a radial bearing 4*b* provided on a loaded side (on the right in FIG. 2 and on the left in FIG. 3) and, for example, a thrust bearing 4*c* provided on an unloaded side (on the left in FIG. 2 and on the right in FIG. 3) to be rotationally driven. A flange 4*d* of the motor 4 is fixed to a side surface on one side (on a lower side in FIG. 1, on the left in FIG. 2 and on the right in FIG. 3) of the gear casing 5 by means of bolts 9. An opening is formed on the one side surface of the gear casing 5 to correspond to the flange 4*d* of the motor 4, and a bull gear 10 is fitted onto that tip end of the rotating shaft 4*a* of the motor 4 in the gear casing 5, which is inserted through the opening.

The low pressure stage compressor body 2 is a screw compressor of, for example, an oil free type (operated with an interior of a compressive working chamber in an oilless state) comprising a male rotor 2*a* and a female rotor 2*b*, of which rotating shafts are in parallel to each other and which rotate so that spiral teeth thereof mesh with each other. One ends (on the lower side in FIG. 1, and on the left in FIG. 2) of the male rotor 2*a* and the female rotor 2*b* have timing gears (not shown), respectively, fitted thereon. Thereby, the male rotor 2*a* and the female rotor 2*b* rotate in non contact and in an oilless state. A flange 2*c* of the low pressure stage compressor body 2 is fixed to one side surface of the gear casing 5 by means of bolts 11 so as to be positioned above (on an upper side in FIGS. 2 to 4) the flange 4*d* of the motor 4. The male rotor 2*a* is arranged inside (on the left in FIG. 4) and the female rotor 2*b* is arranged outside (on the right in FIG. 4) so as to be made in parallel to the rotating shaft 4*a* of the motor 4. An opening is formed on the one side surface of the gear casing 5 to correspond to the flange 2*c* of the low pressure stage compressor body 2, and a pinion gear 12 is fitted onto a tip end of the male rotor 2*a* on the other side (on an upper side in FIG. 1 and on the right in FIG. 2), the tip end being inserted through the opening.

Likewise, the high pressure stage compressor body 3 is a screw compressor of, for example, an oil free type comprising a male rotor 3*a* and a female rotor 3*b*, of which rotating shafts are in parallel to each other and which rotate so that spiral teeth thereof mesh with each other. One ends (on the lower side in FIG. 1 and on the left in FIG. 2) of the male rotor 2*a* and the female rotor 2*b* having timing gears (not shown), respectively, fitted thereon. Thereby, the male rotor 3*a* and the female rotor 3*b* rotate in non contact and in an oilless state. A flange 3*c* of the high pressure stage compressor body 3 is fixed to one side surface of the gear casing 5 by means of bolts 13 so as to be positioned above the flange 4*d* of the motor 4. The male rotor 3*a* is arranged inside (on the right in FIG. 4) and the female rotor 3*b* is arranged outside (on the left in FIG. 4) so as to be made in parallel to the rotating shaft 4*a* of the motor 4. An opening is formed on the one side surface of the gear casing 5 to correspond to the flange 3*c* of the high pressure stage compressor body 3, and a pinion gear 14 is fitted onto a tip end of the male rotor 3*a* on the other side (on the upper side in FIG. 1 and on the left in FIG. 3), the tip end being inserted through the opening.

An intermediate shaft 16 is provided in the gear casing 5 to be supported rotatably through, for example, a thrust bearing 15A and a radial bearing 15B, the intermediate shaft 16 being made in parallel to the rotating shaft 4*a* of the motor 4, the male rotor 2*a* of the low pressure stage compressor body 2, the male rotor 3*a* of the high pressure stage compressor body 3, and the like. The radial bearing 15B is provided, for example, on the one side of the gear casing, and the thrust bearing 15A is provided, for example, on a bearing support 17 mounted to an opposite side (on the upper side in FIG. 1, on the right in FIG. 2, and on the left in FIG. 3) of the gear casing 5. A cover 18 is mounted to the bearing support 17.

Fitted onto the intermediate shaft 16 are a pinion gear 19 (first speed-increasing gear), which meshes with the bull gear 10 on the rotating shaft 4*a* of the motor 4, and a bull gear 20 (second speed-increasing gear), which meshes with the pinion gear 12 on the male rotor 2*a* of the low pressure stage compressor body 2 and the pinion gear 14 on the male rotor 3*a* of the high pressure stage compressor body 3. A working pitch diameter of the pinion gear 19 on the intermediate shaft 16 is smaller than that of the bull gear 10 on the rotating shaft 4*a* of the motor 4, so that a rotational power of the rotating shaft 4*a* of the motor 4 is increased in speed and transmitted to the intermediate shaft 16 through the bull gear 10 and the pinion gear 19. A working pitch diameter of the bull gear 20 on the intermediate shaft 16 is larger than that of the pinion gear 12 on the male rotor 2*a* of the low pressure stage compressor body 2 and that of the pinion gear 14 on the male rotor 3*a* of the high pressure stage compressor body 3, so that a rotational power of the intermediate shaft 16 is increased in speed and transmitted to the male rotor 2*a* of the low pressure stage compressor body 2 and the male rotor 3*a* of the high pressure stage compressor body 3, respectively, through the bull gear 20 and the pinion gears 12, 14.

Thus, according to the embodiment, the intermediate shaft 16 is provided to comprise the pinion gear 19, which meshes with the bull gear 10 on the rotating shaft 4*a* of the motor 4, and the bull gear 20, which meshes with the pinion gear 12 provided on the male rotor 2*a* of the low pressure stage compressor body 2 and the pinion gear 14 provided on the male rotor 3*a* of the high pressure stage compressor body 3. A speed increasing ratio of the bull gear 10 and the pinion gear 19, and a speed increasing ratio of the bull gear 20 and the pinion gear 12 (or the bull gear 20 and the pinion gear 14) cause a rotational power of the rotating shaft 4*a* of the motor 4 to be increased in speed in two stages and transmitted, thus rotationally driving the male rotor 2*a* of the low pressure stage compressor body 2 (or the male rotor 3*a* of the high pressure stage compressor body 3).

Thereby, as compared with the case where, for example, the bull gear provided on the rotating shaft 4*a* of the motor 4 meshes with the pinion gears, respectively, provided on the male rotors 2*a*, 3*a* to provide for an increase of speed in one stage, the motor 4 can be relatively low in rotating speed while the gears are inhibited from being increased in diameter. That is, it is possible to meet with even the case where, for example, gears in a compressor unit of a large capacity with an output of several hundreds kilowatts are restricted in size in terms of a manufacturing facility, and to facilitate manufacture thereof. Furthermore, for example, a four-pole motor can be used for the motor 4, which is relatively low in rotating speed. Accordingly, it is possible to achieve reduction in cost.

In addition, by inhibiting gears from being increased in diameter, it is possible to inhibit the gear casing 5 from being made large in size. Also, by decreasing the motor 4 in rotating speed, a load is reduced, so that it is possible to improve reliability of parts such as bearings, etc.

Furthermore, by providing the motor 4, the low pressure stage compressor body 2, and the high pressure stage compressor body 3 on the one side (in other words, one side of the rotating shaft 4*a* and the male rotors 2*a*, 3*a* in an axial direction) of the gear casing 5, the whole axial dimension composed of the motor 4, the low pressure stage compressor body 2, the high pressure stage compressor body 3, etc. can be shortened as compared with the case where, for example, the motor 4 is arranged on the one side of the gear casing 5, and the low pressure stage compressor body 2 and the high pressure stage compressor body 3 are arranged on the other side. Accordingly, an arrangement of a compressor unit (see a second embodiment) described later can be heightened in freedom of layout.

FIGS. 6 to 11 show a second embodiment of the invention. The embodiment is one of a compressor unit, on which the first embodiment is mounted.

Figure 6:
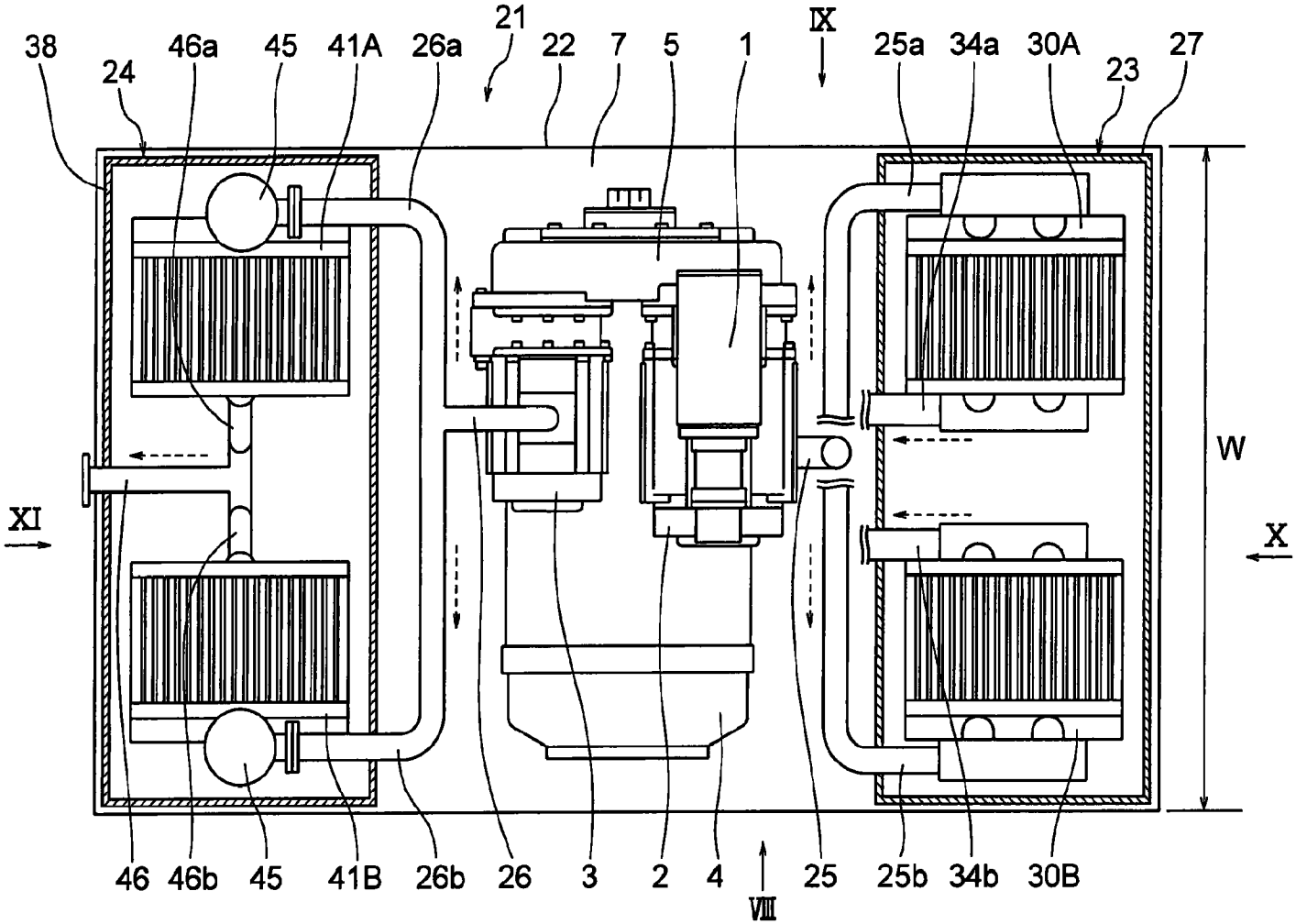
FIG. 6 is a plan, perspective view showing the construction of a second embodiment of a screw compressor according to the invention.
Figure 7:
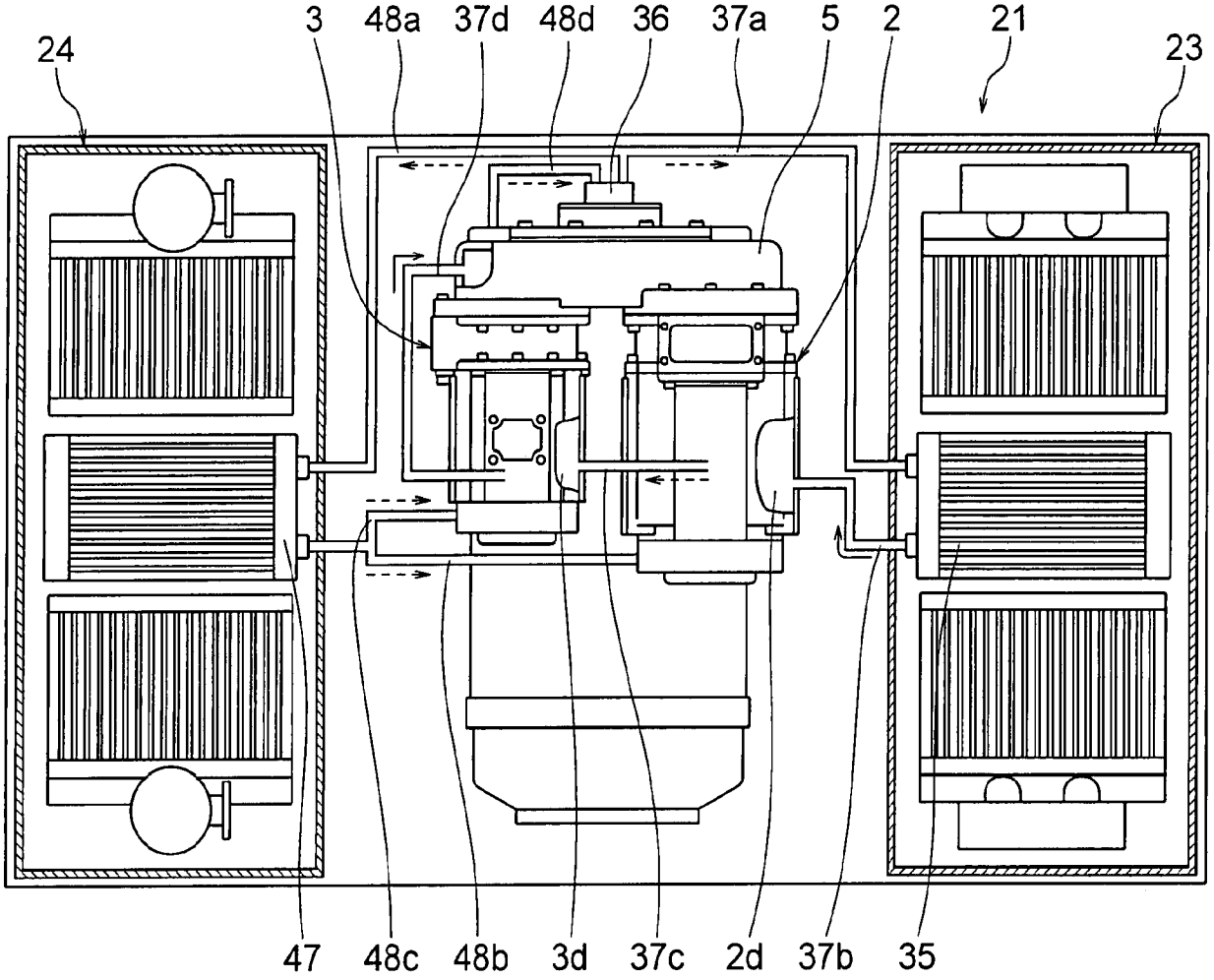
FIG. 7 is a plan, perspective view showing, in side view, the construction of the second embodiment of a screw compressor according to the invention.
Figure 8:
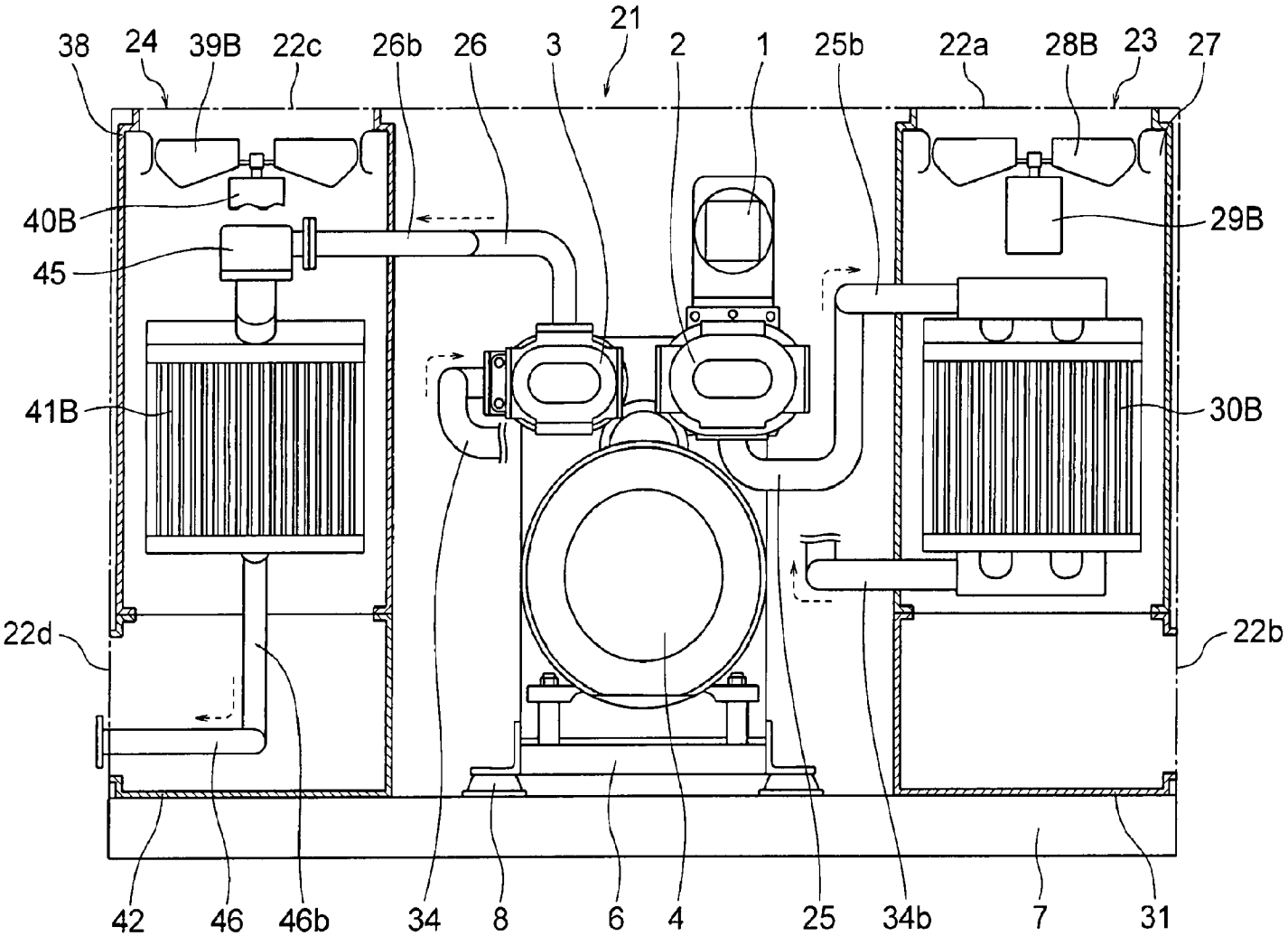
FIG. 8 is a side, perspective view showing the compressor unit as viewed in a direction of an arrow VIII in FIG. 6.
Figure 9:
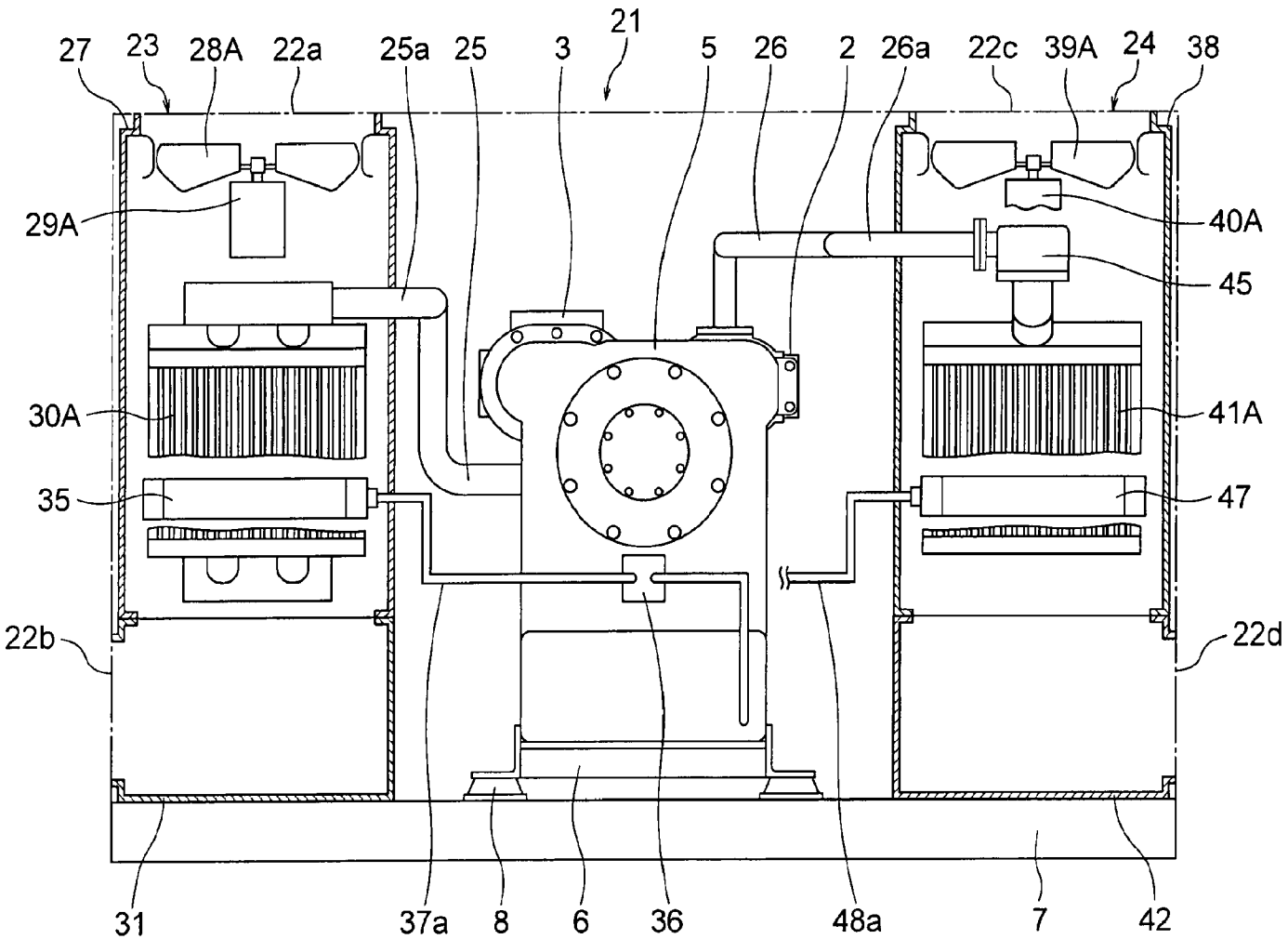
FIG. 9 is a side, perspective view showing the compressor unit as viewed in a direction of an arrow IX in FIG. 6.
Figure 10:
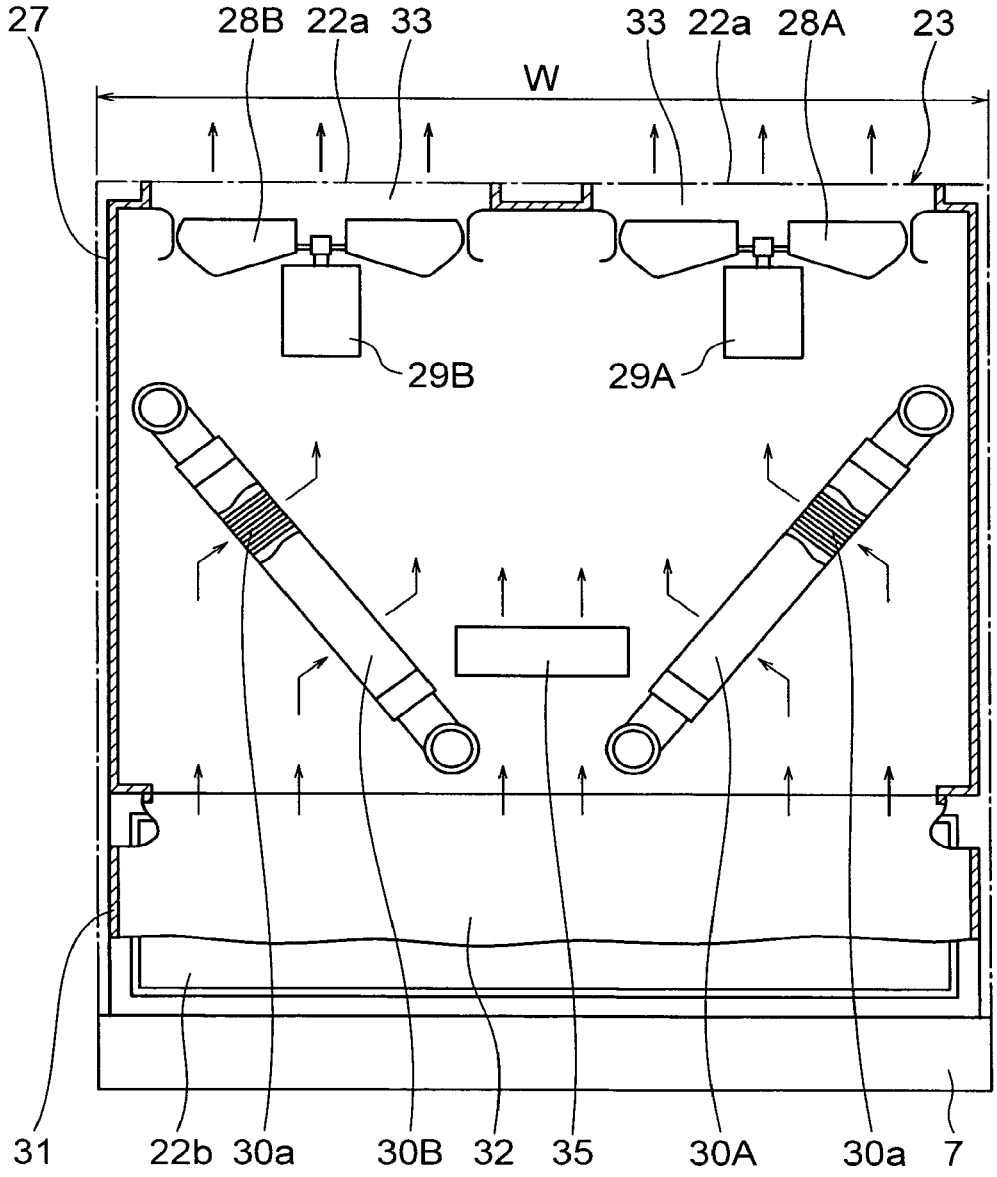
FIG. 10 is a side, perspective view showing a first cooling apparatus as viewed in a direction of an arrow X in FIG. 6.
Figure 11:
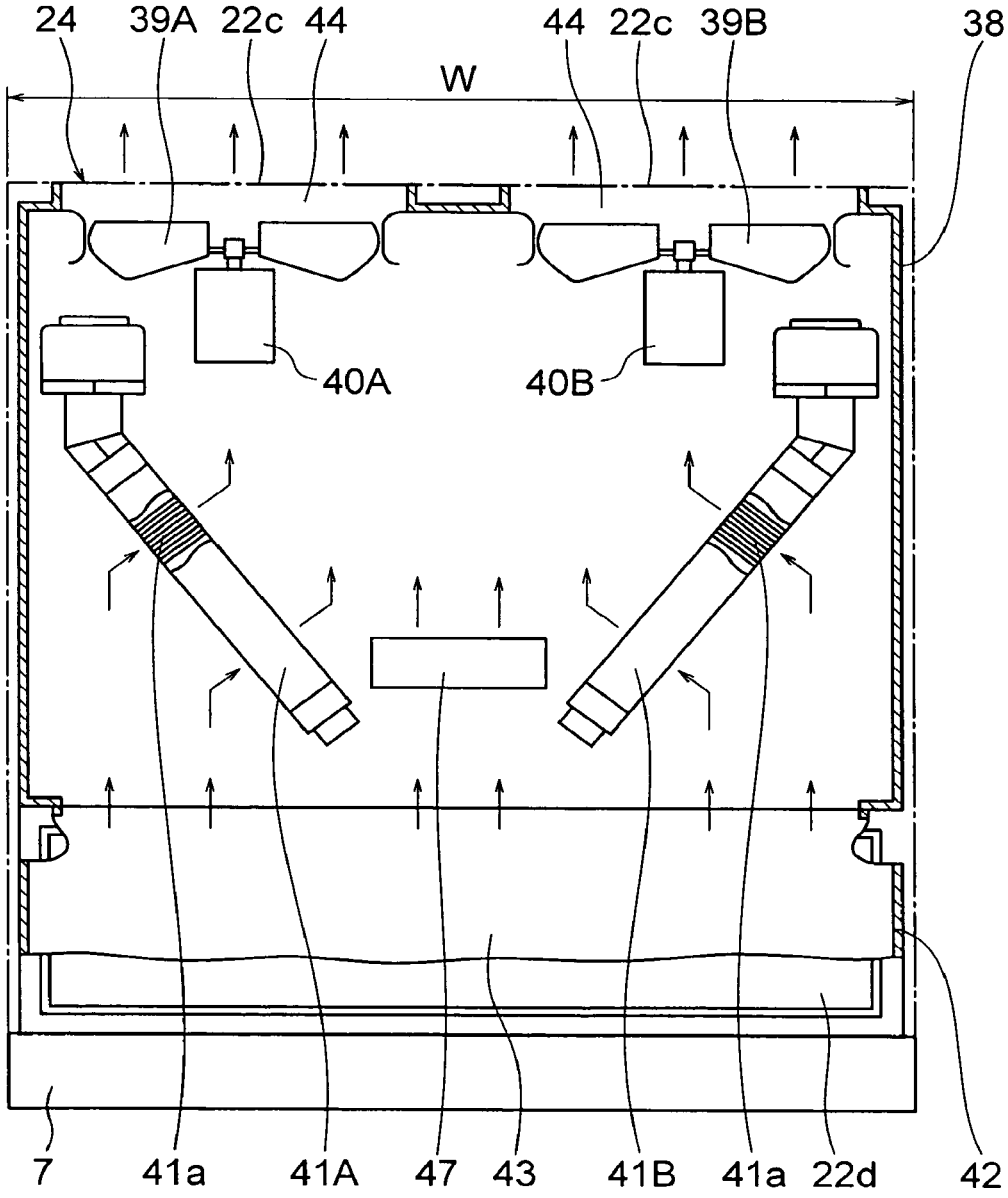
FIG. 11 is a side, perspective view showing a second cooling apparatus as viewed in a direction of an arrow XI in FIG. 6.

FIG. 6 is a plan, perspective view showing a compressor unit representative of the construction of a screw compressor according to the embodiment (a cooling fan, a fan motor, and an oil cooler are not shown for the sake of convenience) and showing a compressed air system. FIG. 7 is a plan, perspective view showing the compressor unit representative of the construction of the screw compressor according to the embodiment (a suction throttle valve, a cooling fan, and a fan motor are not shown for the sake of convenience) and showing an oil system. FIG. 8 is a side, perspective view showing the compressor unit as viewed in a direction indicated by an arrow VIII in FIG. 6 and showing the compressed air system and the oil system. FIG. 9 is a side, perspective view showing the compressor unit as viewed in a direction indicated by an arrow IX in FIG. 6 (a suction throttle valve is not shown for the sake of convenience) and showing the compressed air system. FIG. 10 is a side, perspective view showing a first cooling apparatus as viewed in a direction indicated by an arrow X in FIG. 6, and FIG. 11 is a side, perspective view showing a second cooling apparatus as viewed in a direction indicated by an arrow XI in FIG. 6 (a supply pipe is not shown for the sake of convenience). In FIGS. 6 to 11, parts equivalent to those in the first embodiment are denoted by the same reference numerals as those in the latter, and an explanation therefor is omitted suitably.

In the embodiment, for example, a compressor unit 21 of a large capacity (an output in the order of several hundreds kilowatts) is a package type compressor unit covered by a sound-proof cover 22 or the like. The motor 4, the gear casing 5, the low pressure stage compressor body 2, and the high pressure stage compressor body 3 are mounted centrally of the base 7. As described in the first embodiment, since the whole axial dimension composed of the motor 4, the low pressure stage compressor body 2, the high pressure stage compressor body 3, etc. is relatively short, axial directions of the rotating shaft 4*a* of the motor 4, the male rotor 2*a* and the female rotor 2*b* of the low pressure stage compressor body 2, and the male rotor 3*a* and the female rotor 3*b* of the high pressure stage compressor body 3 are oriented in a short width direction (a vertical direction in FIGS. 6 and 7) of the compressor unit 21. That is, such arrangement makes it possible to shorten a dimension W of the compressor unit 21 in the short width direction.

A first cooling apparatus 23 that cools a compressed air from the low pressure stage compressor body 2 is mounted on the base 7 on one side (on the right in FIGS. 6 to 8, and on the left in FIG. 9) of the compressor unit 21 in a long width direction, with the motor 4, the gear casing 5, the low pressure stage compressor body 2, the high pressure stage compressor body 3, etc. therebetween. A second cooling apparatus 24 that cools a compressed air from the high pressure stage compressor body 3 is mounted on the base 7 on the other side (on the left in FIGS. 6 to 8, and on the right in FIG. 9) of the compressor unit 21 in the long width direction. In this manner, by arranging the first cooling apparatus 23 and the second cooling apparatus 24 independently and separately, it is possible to arrange elements in the compressor unit 21 in an efficient and well-balanced manner.

The low pressure stage compressor body 2 is arranged in the gear casing 5 on one side of the compressor unit 21 in the long width direction. Thereby, it is possible to shorten a connection pipe (a discharge pipe 25, etc. described later) between the low pressure stage compressor body 2 and the first cooling apparatus 23. The high pressure stage compressor body 3 is arranged in the gear casing 5 on the other side of the compressor unit 21 in the long width direction. Thereby, it is possible to shorten a connection pipe (a discharge pipe 26, etc. described later) between the high pressure stage compressor body 3 and the second cooling apparatus 24.

The first cooling apparatus 23 comprises: a duct 27 arranged in a substantially vertical direction (a vertical direction in FIGS. 8 to 10) and connected to a first exhaust port 22*a* provided on an upper surface of the sound-proof cover 22; fan motors 29A, 29B, respectively, provided upward (upward in FIGS. 8 to 10) in the duct 27 and provided with cooling fans 28A, 28B, which generate a cooling wind (shown by arrows in FIG. 10) directed upward; intercoolers 30A, 30B, respectively, provided upstream (downward in FIG. 10) of the fan motors 29A, 29B in the duct 27 to cause a compressed air from the low pressure stage compressor body 2 to be cooled by heat exchange with a cooling wind; and an air intake duct 31 connected to an underside of the duct 27 and connected to a first air intake port 22*b* provided on lower portions of sides of the soundproof cover 22.

When the cooling fans 28A, 28B are rotated as the fan motors 29A, 29B are driven, an outside air from the first air intake port 22*b* is introduced as a cooling wind into the air intake duct 31 and a cooling wind in the duct 27 flows upward to be discharged from the first exhaust port 22*a* via the intercoolers 30A, 30B and the cooling fans 28A, 28B. At this time, the air intake duct 31 defines an intake flow passage 32 (intake space) between the first air intake port 22*b* and the intercoolers 30A, 30B, and an exhaust flow passage 33 (exhaust space) is also defined between the cooling fans 28A, 28B in the duct 27 and the first exhaust port 22*a*. Thereby, as compared with, for example, the case where the intake flow passage 32 and the exhaust flow passage 33 are not defined (more specifically, the case where intercoolers are provided to abut against the first air intake port 22*b* and the case where cooling fans are provided to abut against the first exhaust port 22*a*), it is possible to reduce leakage of noise generated by the intercoolers 30A, 30B, etc.

The cooling fans 28A, 28B are arranged in juxtaposition with each other in the short width direction (a left and right direction in FIG. 10) of the compressor unit 21, and the intercoolers 30A, 30B are arranged in juxtaposition with each other in the short width direction of the compressor unit 21 in a manner to pair with the cooling fans 28A, 28B, respectively (in other words, the intercoolers 30A, 30B are arranged in juxtaposition with each other with respect to a flow of a cooling wind in the duct 27). The intercoolers 30A, 30B, respectively, are connected to branch pipes 25*a*, 25*b* of the discharge pipe 25 connected to a discharge side of the low pressure stage compressor body 2, and are also connected to branch pipes 34*a*, 34*b* of a suction pipe 34 connected to a suction side of the high pressure stage compressor body 3. The intercoolers 30A, 30B, respectively, use a cooling wind, which passes through fins 30*a*, to cool a compressed air from the low pressure stage compressor body 2, and supplies the cooled, compressed air to the high pressure stage compressor body 3. In this manner, by providing the intercoolers 30A, 30B in two systems, it is possible to make the single intercooler 30A or 30B small in size and to facilitate manufacture thereof even in the case where its size is restricted by, for example, existent manufacturing components, etc. By arranging the intercoolers 30A, 30B in juxtaposition with a flow of a cooling wind, pressure loss is decreased as compared with, for example, the case where intercoolers are arranged in series, so that it is possible to reduce power required for the fan motors 29A, 29B.

The intercoolers 30A, 30B are provided to be inclined relative to a flow of a cooling wind in a vertical direction within the duct 27 (more specifically, provided to be inclined outward upwardly in the short width direction of the compressor unit 21 and arranged in a V-shaped configuration). Thereby, it is possible to decrease a widthwise dimension of the first cooling apparatus, that is, a dimension W of the compressor unit in the short width direction. The intercoolers 30A, 30B may be provided to be inclined upward in the short width direction of the compressor unit 21 and made in parallel to each other.

For the sake of an efficient arrangement, a jacket system oil cooler 35 is provided between the intercoolers 30A, 30B. An oil supplied through an oil pipe 37*a* from the oil reservoir in the gear casing 5 by an oil pump 36 is caused by the jacket system oil cooler 35 to exchange heat with a cooling wind to be cooled, and the cooled oil is supplied through an oil pipe 37*b* to a liquid-cooled jacket 1*d* of the low pressure stage compressor body 2. The oil having cooled the liquid-cooled jacket 1*d* of the low pressure stage compressor body 2 is introduced through an oil pipe 37*c* into a liquid-cooled jacket 3*d* of the high pressure stage compressor body 3 to be cooled, and thereafter returned through an oil pipe 37*d* to the oil reservoir in the gear casing 5.

The second cooling apparatus 24 is constructed in the same manner as the first cooling apparatus 23, and comprises: a duct 38 provided in a substantially vertical direction (a vertical direction in FIGS. 8, 9 and 11) and connected to a second exhaust port 22*c* provided on the upper surface of the soundproof cover 22; fan motors 40A, 40B, respectively, provided upward (upward in FIGS. 8, 9 and 11) in the duct 38 and provided with cooling fans 39A, 39B, which generate a cooling wind (shown by arrows in FIG. 11) directed upward; aftercoolers 41A, 41B provided upstream (downward in FIG. 11) of the cooling fans 39A, 39B in the duct 38 to cause a compressed air from the high pressure stage compressor body 3 to be cooled by heat exchange with a cooling wind; and an air intake duct 42 connected to an underside of the duct 38 and connected to a second air intake port 22*d* provided on the lower portion of the side of the soundproof cover 22.

When the cooling fans 39A, 39B are rotated as the fan motors 40A, 40B are driven, an outside air from the second air intake port 22*d* is introduced as a cooling wind into the air intake duct 42 and a cooling wind in the duct 38 flows upward to be discharged from the second exhaust port 22*c* via the aftercoolers 41A, 41B and the cooling fans 39A, 39B. At this time, the air intake duct 42 defines an intake flow passage 43 (intake space) between the second air intake port 22*d* and the aftercoolers 41A, 41B, and an exhaust flow passage 44 (exhaust space) is also defined between the cooling fans 39A, 39B in the duct 38 and the second exhaust port 22*c*. Thereby, as compared with the case where, for example, the intake flow passage 43 and the exhaust flow passage 44 are not defined (more specifically, the case where aftercoolers are provided to abut against the second air intake port 22*d* and the case where cooling fans are provided to abut against the second exhaust port 22*c*), it is possible to reduce leakage of noise generated by the aftercoolers 41A, 41B, etc.

The cooling fans 39A, 39B are arranged in juxtaposition with each other in the short width direction (a left and right direction in FIG. 10) of the compressor unit 21, and the aftercoolers 41A, 41B are arranged in juxtaposition with each other in the short width direction of the compressor unit 21 in a manner to pair with the cooling fans 39A, 39B, respectively (in other words, the aftercoolers 41A, 41B are arranged in juxtaposition with each other with respect to a flow of a cooling wind in the duct 38). The aftercoolers 41A, 41B, respectively, are connected through a check valve 45 to branch pipes 26*a*, 26*b* of the discharge pipe 26 connected to a discharge side of the high pressure stage compressor body 3, and are also connected to branch pipes 46*a*, 46*b* of a supply pipe 46, which supplies a compressed air to a side of a user. The aftercoolers 41A, 41B, respectively, use a cooling wind, which passes through fins 41*a*, to cool a compressed air from the high pressure stage compressor body 3, and supplies the cooled, compressed air to a side of a user. In this manner, by providing the aftercoolers 41A, 41B in two systems, it is possible to make the single aftercooler 41A or 41B small in size and to facilitate manufacture thereof even in the case where its size is restricted by, for example, existent manufacturing components, etc. By arranging the aftercoolers 41A, 41B in juxtaposition with a flow of a cooling wind, pressure loss is decreased as compared with the case where, for example, aftercoolers are arranged in series, so that it is possible to reduce power required for the fan motors 40A, 40B.

The aftercoolers 41A, 41B are provided to be inclined relative to a flow of a cooling wind in a vertical direction within the duct 38 (more specifically, provided to be inclined outwardly upwardly in the short width direction of the compressor unit 21 and arranged in a V-shaped configuration). Thereby, it is possible to decrease a widthwise dimension of the second cooling apparatus 24, that is, a dimension W of the compressor unit 21 in the short width direction. In addition, the aftercoolers 41A, 41B may be provided to be inclined upward, for example, in the short width direction of the compressor unit 21 and made in parallel to each other.

For the sake of an efficient arrangement, a lubrication system oil cooler 47 is provided between the aftercoolers 41A, 41B. An oil supplied through an oil pipe 48*a* from the oil reservoir in the gear casing 5 by the oil pump 36 is caused by the lubrication system oil cooler 47 to exchange heat with a cooling wind to be cooled, and the cooled oil is supplied through oil pipes 48*b*, 48*c* to bearing-timing gear portions of the low pressure stage compressor body 2 and the high pressure stage compressor body 3. The oil having cooled the bearing-timing gear portions of the low pressure stage compressor body 2 and the high pressure stage compressor body 3 is returned through an oil pipe 48*d* to the oil reservoir in the gear casing 5.

As described above, according to the embodiment, it is possible to make the whole unit small in size, and it is possible to greatly produce the effect, in particular, in the compressor unit 21 of a large capacity type. Furthermore, the compressor unit 21 is made small in size whereby it is possible to make conveyance means therefor small in size.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A screw compressor unit comprising: a low pressure stage compressor body; a high pressure stage compressor body that further compresses a compressed air compressed by the low pressure stage compressor body; a plurality of rotor side gears, respectively, provided on rotor shafts of the low pressure stage compressor body and the high pressure stage compressor body; a motor including a motor body and a rotating shaft; a gear casing that accommodates therein a motor side gear and the rotor side gears; a first cooling apparatus that cools a compressed air from the low pressure stage compressor body; and a second cooling apparatus that cools a compressed air from the high pressure stage compressor body, wherein the first and second cooling apparatuses, respectively, comprise: a duct provided in a substantially vertical direction; a cooling fan provided in the duct to generate a cooling wind; and a heat exchanger for compressed air, provided upstream of the cooling fan in the duct to exchange heat with the cooling wind to cool the compressed air from the low pressure stage compressor body or the high pressure stage compressor body, wherein the low pressure stage compressor body and the high pressure stage compressor body are placed in parallel overlying at least a portion of the motor body, wherein the rotating shaft of the motor and the rotor shafts of the low pressure stage compressor body and the high pressure stage compressor body extend from one side of the gear casing, and wherein the motor, the gear casing, the low pressure stage compressor body, and the high pressure stage compressor body are arranged centrally of the compressor unit, the first cooling apparatus is arranged on one side in a long width direction of the compressor unit, and the second cooling apparatus is arranged on another side in the long width direction of the compressor unit.

2. The screw compressor according to claim 1, wherein the rotating shaft of the motor and the rotor shafts of the low pressure stage compressor body and the high pressure stage compressor body are arranged parallel to each other with axial directions thereof oriented in a short width direction of the compressor unit, and the motor, the low pressure stage compressor body and the high pressure stage compressor body are arranged above the motor.

3. The screw compressor according to claim 2, wherein the low pressure stage compressor body is arranged on one side in a long width direction of the compressor unit in the gear casing, and the high pressure stage compressor body is arranged on another side in the long width direction of the compressor unit in the gear casing.

4. The screw compressor according to claim 1, wherein the duct is connected to an air intake port and an exhaust port of the compressor unit, an intake space is formed between the air intake port and the heat exchanger for compressed air, and an exhaust space is formed between the cooling fan and the exhaust port.

5. The screw compressor according to claim 1, wherein one of or both of the first and second cooling apparatuses are provided with a plurality of heat exchangers for compressed air, and the plurality of the heat exchangers for compressed air are arranged in juxtaposition with a flow of the cooling wind.

6. The screw compressor according to claim 5, wherein the cooling fans are provided in plural so as to pair with the plurality of the heat exchangers and are arranged in juxtaposition with one another.

7. The screw compressor according to claim 5, wherein the plurality of the heat exchangers for compressed air are arranged in juxtaposition with one another in a short width direction of the compressor unit.

8. The screw compressor according to claim 1, wherein the heat exchanger for compressed air is provided in a manner to be inclined to a vertical flow of a cooling wind in the duct.

9. The screw compressor according to claim 1, wherein one of or both of the first and second cooling apparatuses are provided with a plurality of heat exchangers for compressed air, the plurality of the heat exchangers for compressed air are inclined to vertical flow of a cooling wind in the duct and arranged in juxtaposition therewith, and heat exchangers for oil are provided between the plurality of the heat exchangers for compressed air.

* * * * *